United States Patent [19]

McNally

[11] 3,997,751

[45] Dec. 14, 1976

[54] ACCESS DOOR LATCH MECHANISM

[75] Inventor: William J. McNally, Newton, Iowa

[73] Assignee: The Maytag Company, Newton, Iowa

[22] Filed: Feb. 24, 1975

[21] Appl. No.: 552,190

[52] U.S. Cl. ..... 200/61.62; 68/12 R; 192/136; 200/61.45 R; 210/146

[51] Int. Cl.[2] ..... D06F 33/02; D06F 37/28; H01H 35/00; H01H 3/20

[58] Field of Search ..... 192/136; 210/146; 134/58 D, 58 DL; 200/61.62, 61.64–61.67, 61.76–61.8, 61.45 R; 68/12 R, 23.1, 24

[56] References Cited

UNITED STATES PATENTS

| | | | |
|---|---|---|---|
| 2,957,959 | 10/1960 | Mellinger | 200/61.76 |
| 3,145,818 | 8/1964 | Stelli | 200/61.62 X |
| 3,227,835 | 1/1966 | Conrath | 200/61.45 R |
| 3,387,873 | 6/1968 | Prosser et al. | 292/175 |
| 3,488,463 | 1/1970 | Mellinger | 200/61.76 |
| 3,504,777 | 4/1970 | Waugh | 192/136 |
| 3,716,122 | 2/1973 | Baker et al. | 192/136 |
| 3,734,290 | 5/1973 | Nelson | 210/146 |
| 3,736,772 | 6/1973 | Baker | 68/12 R |
| 3,763,670 | 10/1973 | Harrold | 192/136 X |

*Primary Examiner*—James R. Scott
*Attorney, Agent, or Firm*—Richard L. Ward

[57] ABSTRACT

A selectively operable latch mechanism for the access door of an apparatus having a rotatable member provides a positive latching of the access door when the rotatable member is operating. An associated unbalance-responsive mechanism will unlatch said access door when an unbalance condition has occurred and will stop the rotation of said rotatable member.

11 Claims, 8 Drawing Figures

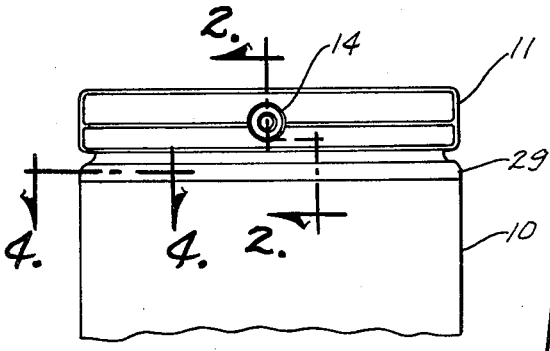
Fig. 1
Fig. 8
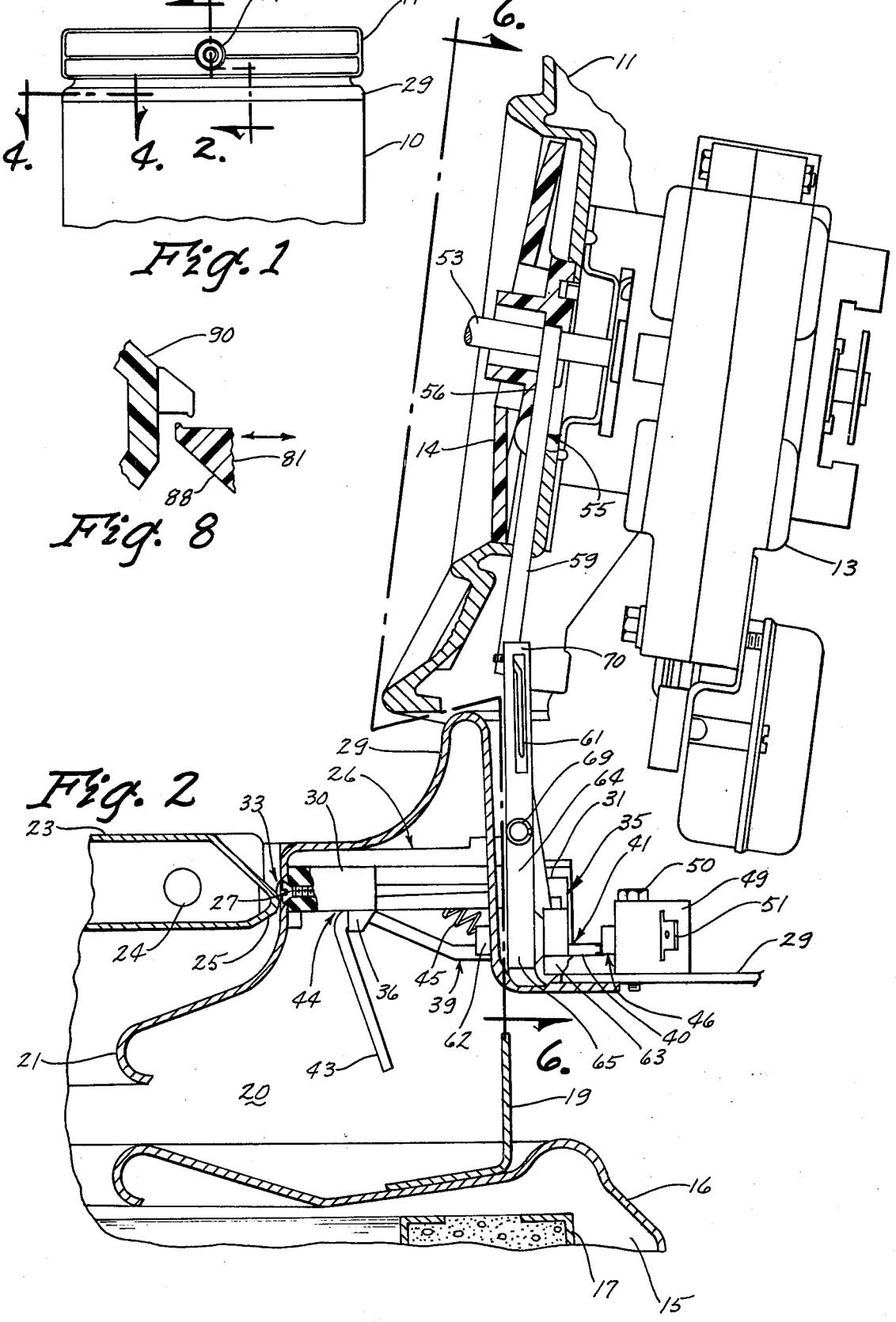
Fig. 2

ACCESS DOOR LATCH MECHANISM

BACKGROUND OF THE INVENTION

1. Field of the Invention:

This invention relates to a latch mechanism and more particularly to a selectively operable latch mechanism that can be combined with an unbalance-sensitive latch release mechanism to provide a means for positively locking the access door of a centrifugal extractor during an extraction operation and to means for unlocking said access door responsive to an unbalance condition.

2. Description of the Prior Art:

The prior art shows a continuing search for a control system for a rotating apparatus, such as a laundry appliance, to insure safe operation of the apparatus. Previous work in the appliance field also shows it to be desirable to prevent access to the fabric container of a centrifugally operable washing machine during the extraction operation. Early systems for achieving this desired objective disclose switching means responsive to the opening of the access door for de-energizing the drive system so that the container is not driven while the access door is in the open position. Also shown in prior art are control systems including solenoid or relay operated lid switches controlled by sequential control means so that the solenoid or relay is energized for locking the access door upon energization of the drive system for the extraction operation to avoid or prevent access to the spinning container. Apparatus for solving or otherwise obviating the problems associated with a mechanical, selectively operable normally disengaged latch mechanism is not, however, shown in prior art.

SUMMARY OF THE INVENTION

It is an object of the instant invention to provide a positive latch mechanism that is mechanically operable at predetermined portions of a machine cycle.

It is a further object of the instant invention to provide a positive latch release mechanism responsive to an unbalance condition in the apparatus.

It is a further object of the instant invention to provide access to the fabric container in event of said unbalance condition.

Briefly, the instant invention achieves these objects in a normally disengaged latch mechanism that includes mechanically actuated connecting means operatively disposed between a sequential control means and latching means.

Operation of the device and further objects and advantages thereof will become evident as the description proceeds and from an examination of the accompanying three page of drawings.

BRIEF DESCRIPTION OF THE DRAWINGS

The drawings illustrate a preferred embodiment of the invention with similar numerals referring to similar parts throughout the several views, wherein:

FIG. 1 is a partial front view of an automatic washing machine showing the cabinet top, control panel and dial.

FIG. 2 is a fragmentary sectional view through the control panel and cabinet top portions generally taken along Section Line 2—2 of FIG. 1 showing part of the unbalance release mechanism.

FIG. 8 is shown between FIGS. 1 and 2 and is a fragmentary view taken generally along Section Line 8—8 of FIG. 4 showing the latch catch and the latch stop.

DESCRIPTION OF THE PREFERRED EMBODIMENT

Figure 3:
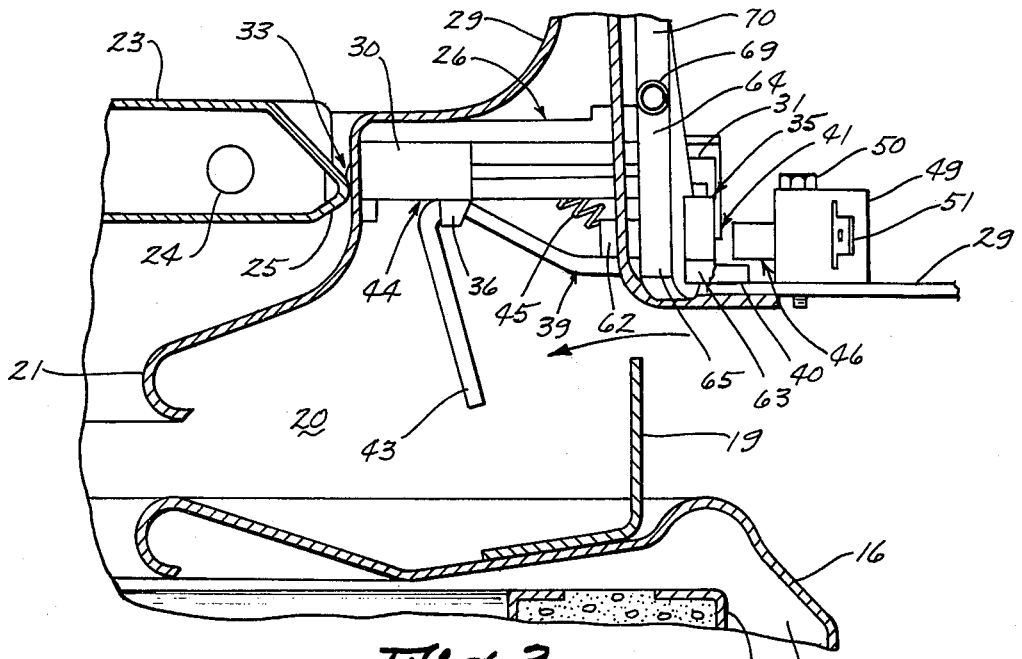
FIG. 3 is a view similar to the lower portion of FIG. 2 showing the unbalance release mechanism in the unbalance condition.

Referring now to the drawings, there is shown in FIG. 1 a partial view of an automatic washing machine including a cabinet 10. The cabinet 10 includes a control panel 11 accommodating various control members such as sequential control means or timer indicated by numeral 13 in FIG. 2 and actuatable by a dial 14.

Mounted within the cabinet 10, as in FIG. 2, is a tub assembly 15 nutationally supported and within which is journalled a rotatable clothes basket 17. The tub assembly 15 includes a tub top cover 16 on which is fixed a bumper 19 that moves with the tub assembly 15 and tub top cover 16. The position of the bumper 19 with respect to the cabinet 10 therefore is determined by the gyration of the tub assembly 15 when the washing machine is energized in the extraction part of the series of operations. The entire washing machine is supported on a frame (not shown).

The cabinet structure 20 includes an access opening 21 through which fabrics may be inserted or removed from the rotatable clothes basket 17. The access opening 21 is closed by an access door 23. The door 23 is pivoted about a fulcrum 24 spaced a short distance from the rear end of the door 23. The rear end 25 of the door 23 functions as a lever with respect to the fulcrum 24 for engaging the unbalance mechanism 26.

The unbalance mechanism 26 is attached to the cabinet top 29 as shown in FIGS. 2 and 3 by means of a pair of screws 27 extending through the cabinet top 29 and threading into the molded plastic body of the unbalance mechanism frame 30.

Figure 6:
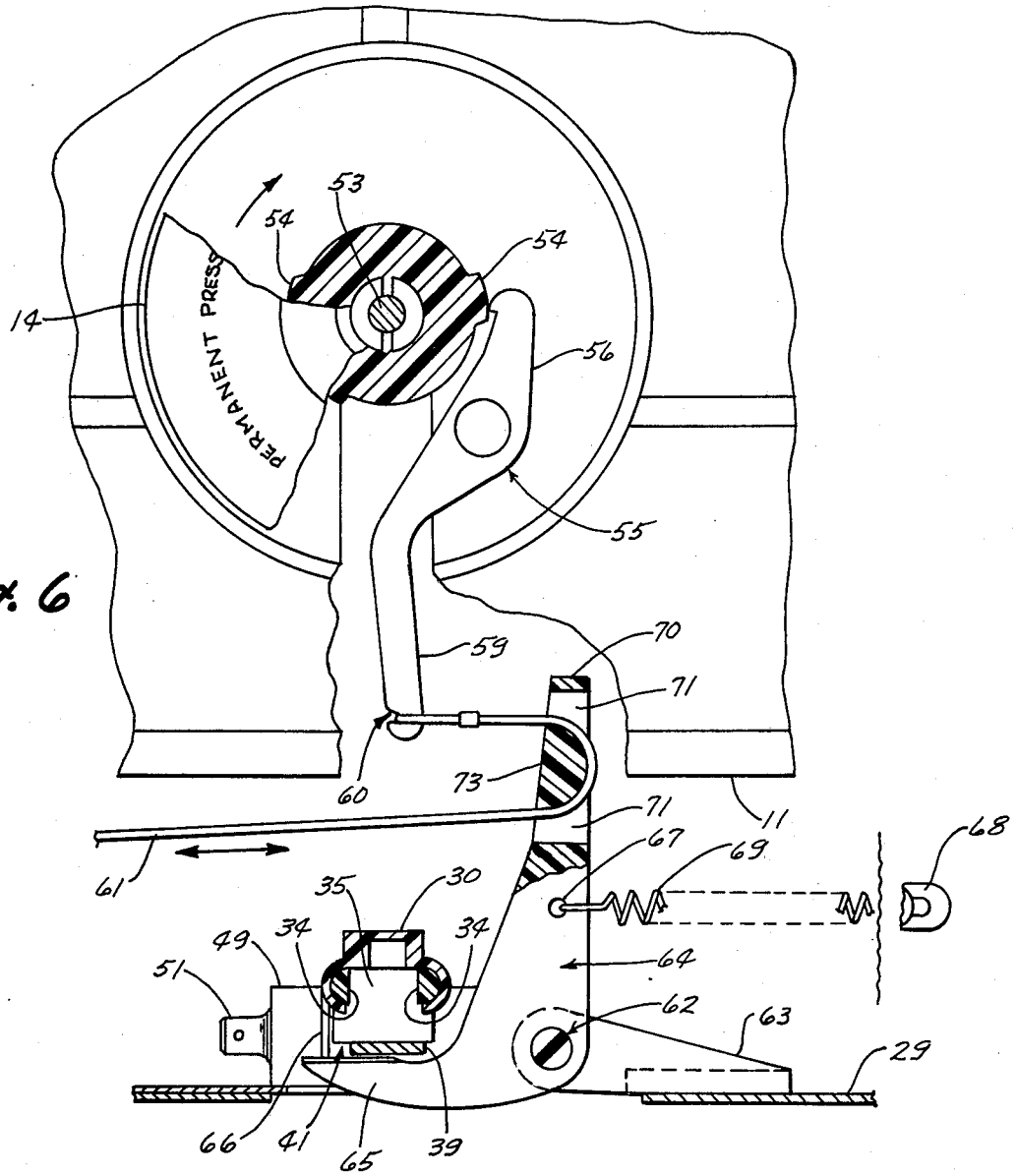
FIG. 6 is a view taken generally along Section Line 6—6 of FIG. 2 generally showing cam surfaces, latch actuator, unbalance release mechanism, actuating means and unbalance mechanism.
Figure 7:
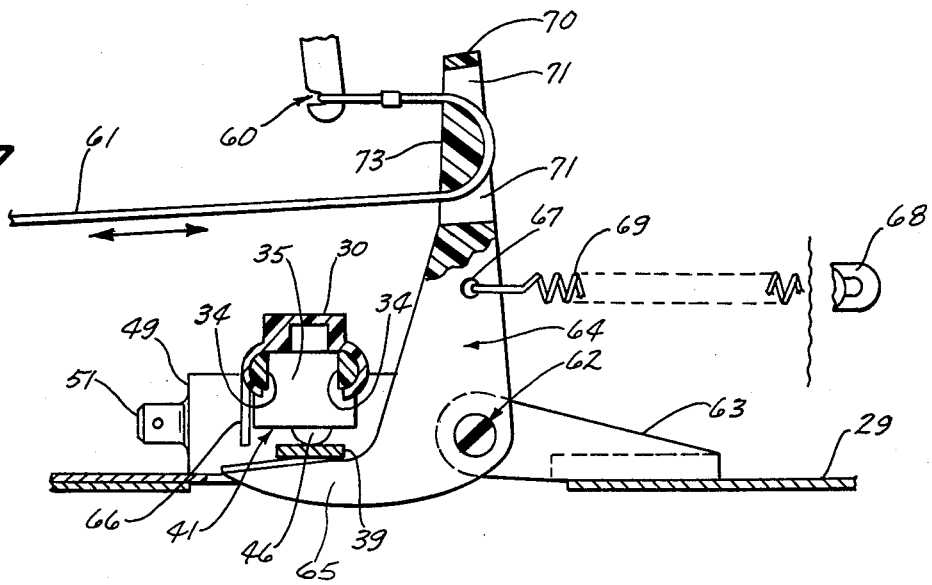
FIG. 7 is similar to the lower portion of FIG. 6 showing elements in the unbalance condition.

A plunger 31 is slidingly supported within the frame 30 of the unbalance mechanism. The front end of the plunger 31 is in the form of a projecting nose 33 extending through the cabinet top 29. The plunger 31 further includes, as best shown in FIGS. 6 and 7, a pair of spaced apart side rails 34 joined at the front and rear. The rear end of the plunger 31 includes a downwardly extending flange 35. The plunger 31 also includes an undercarriage 36 for pivotally supporting the unbalance actuator 39 on the plunger 31.

The unbalance actuator 39 is pivotally supported by the plunger undercarriage 36 and includes a rear end 40 engageable with the bottom edge 41 of the rear flange 35 of the plunger 31. The unbalance actuator 39 further includes a depending lever end 43 extending substantially downwardly from the pivot connection 44 between the unbalance actuator 39 and the plunger 31. The depending lever 43 of the unbalance actuator 39 is positioned for engagement by the bumper 19 upon excessive gyration of the tub assembly 15.

A biasing spring 45 is disposed between the unbalance mechanism frame 30 and the unbalance actuator 39. This angularly disposed biasing spring 45 provides upwardly and forwardly directed components of biasing force. The upwardly directed component of force maintains the rear end 40 of the unbalance actuator 39 against the plunger rear flange 35 or against the lower side of a switch plunger 46. The forwardly directed component of force biases the actuator 39 and plunger 31 in a forward direction to maintain engagement of the plunger nose 33 with the access door 23.

A switch 49 is attached to the cabinet top 29 by a pair of threaded members 50. This switch 49 includes a pair of connector terminals 51 by which the switch 49 may be connected into the circuitry of the drive motor. The switch plunger 46 is biased to the left so that, in the absence of an externally applied force to the right, the plunger 46 will automatically return under the spring biasing to a normal position.

The unbalance mechanism 26 operating in cooperation with the access door 23 causes the plunger 31 of the unbalance mechanism 26 to bias the switch plunger 46 to the right as shown in FIG. 2. In this position, the contacts of the switch are closed and the circuit is completed across the terminals 51 for energizing the drive motor.

The construction and operation of the unbalance mechanism 26 are more clearly and specifically shown in the following patent, which is assigned to the assignee of the instant invention: Mellinger, U.S. Pat. No. 3,488,463 issued Jan. 6, 1970.

Referring to FIG. 2, the sequential control device or timer mechanism 13 is mounted on the rear of the control panel 11 with the operating shaft 53 extending through the control panel 11. Mounted on this operating shaft 53 is a dial 14 which indicates the progression of the washer through its series of operations. As best shown in FIG. 6, the rear of the dial 14 has cam surfaces 54 that correspond to the periods of high speed spinning for water extraction. A latch actuator 55 is pivotally mounted to the control panel 11 behind the dial 14 with the upper portion 56 engaging the cam surface 54 of the dial 14. The lower portion 59 of the latch actuator 55 is angularly displaced to the left and downwardly toward the cabinet top 29. The lower portion 59 has a rectangular notch 60 near the tip to receive the first looped end of the cable 61.

Mounted to the cabinet top 29 to the right of the switch 49, as in FIGS 6 and 7, is a pivot bracket 63. This bracket 63 has an extending arm which in turn has a stud-like projection 62 on which is pivotally mounted a bell crank shaped unbalance-sensitive latch release member 64. The first arm 65 of the bell crank is normally engaged with a downwardly projecting lip 66 of the unbalance mechanism frame 30 and juxtaposed to the rear end 40 of actuator 39 as in FIG. 6. This first arm 65 is biased into this engaging position by a spring 69. One end of this spring 69 is inserted into a through holes 67 on the second arm 70 with the other end attached to a notch 68 in the fixed cabinet top panel 29. The second arm 70 of the crank has two molded slots 71 with the remaining material between the slots 71 acting as a pulley-like cable guide 73 for changing the cable 61 direction.

Figure 4:
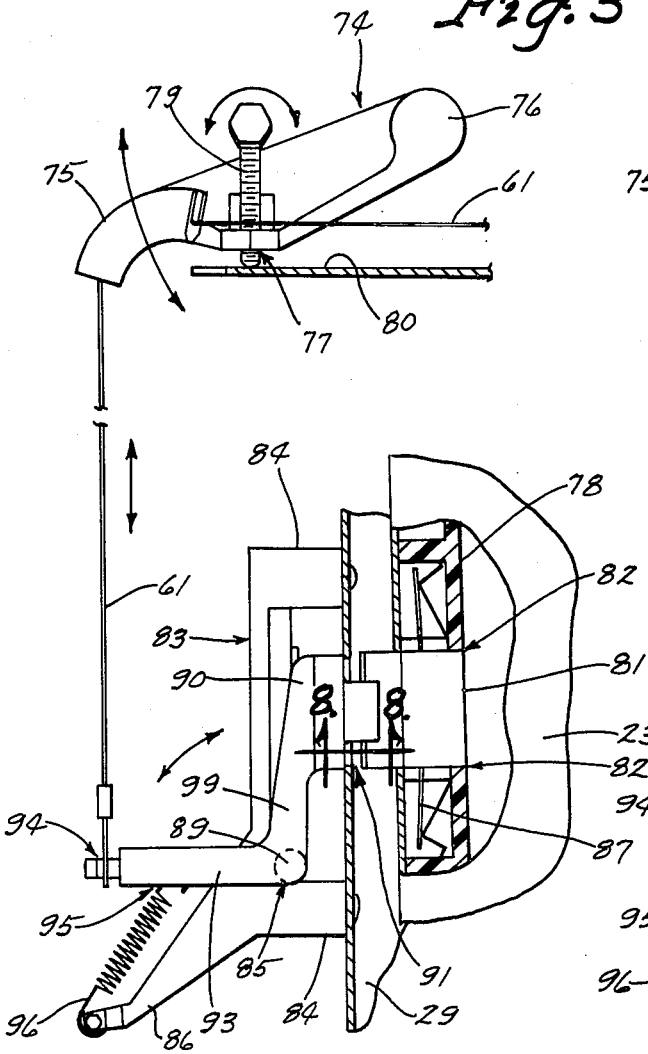
FIG. 4 is a fragmentary sectional view through the cabinet top taken generally along a horizontal plane indicated by Section Line 4—4 of FIG. 1 showing the latch mechanism and also showing the cable adjustment and cornering device.
Figure 5:
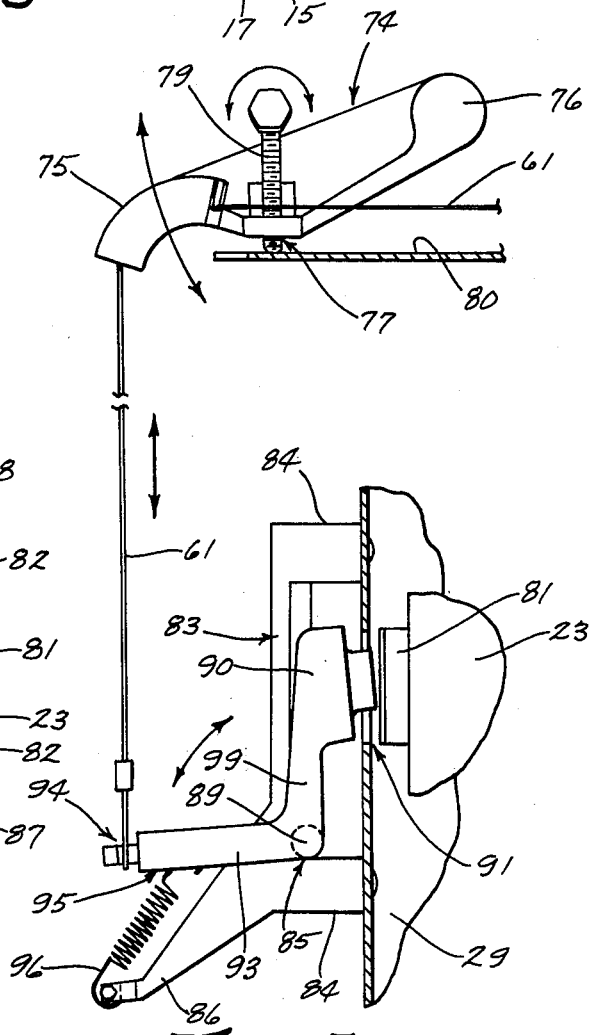
FIG. 5 is a view similar to FIG. 4 showing elements in the unbalance condition.

From the latch actuator 55, the cable 61 travels around the pulley-like guide 73 of the unbalance-sensitive latch release member 64 behind the cabinet top 29 to the left side of the washing machine to a point, as in FIGS. 4 and 5, where a right angle corner must be negotiated to continue the path to the second connection position. At this cornering point a pivotally mounted cable adjustment and corning device 74 is mounted to the underside surface of the cabinet top 29 by means of a self-threading member (not shown). This cornering device 74 has an extending arm with a molded arcuate groove to serve as a cable cornering guide 75. The cable 61 coming from the pulley-like cable guide 73 of the unbalance-sensitive latch release member 64 is placed into the cable cornering guide 75 thereby turning the corner and continuing toward the front of the washing machine. Located between the pivot point 76 and the cable cornering guide 75 is a molded pilot hole 77 for receiving a threaded fastener 79. When this threaded fastener 79 is engaged with the pilot hole 77 and turned, the fastener 79 extends through the body of the cable adjustment and cornering device 74 and contacts the cabinet top wall 80. As the fastener 79 is further turned, the cable adjustment and cornering 74 is forced to pivot thereby tightening or loosening the cable 61 to achieve correct operating tension.

The latch mechanism for latching the access door 23 in the closed position relative to the cabinet top 29 includes, as in FIGS. 4 and 5, an access door mounted latch assembly and a cabinet top mounted latch assembly.

The access door 23 mounted latch assembly as best shown in FIG. 5 comprises a housing 78 which is secured by a pair of screws and provides a pair of slots 82 for slidably supporting a latch stop 81. A leaf spring 87 biases the latch stop 81 toward the left for engagement, as shown in FIGS. 4 and 8, with the bell crank shaped latch catch 90 of the cabinet top cover mounted portion. The latch stop 81 has a downwardly facing ramp 88, as shown in FIG. 8, which allows the latch stop 81 to override the latch catch 90 by sliding to the right in the slots 82 to allow closing of the access door 23 should the cabinet latch catch 90 be in a locking position as in FIG. 4.

The cabinet top mounted latch portion consists of three elements: a mounting element, a bell crank shaped latch member, and a biasing spring. The mounting element 83 is secured to the cabinet top 29 through a pair of legs 84 and includes a concavely radiused pivot point 85 and an angularly extending arm 86. The bell crank shaped latch member 99 includes a transversely extending round shaft 89 mating with the concavely radiused pivot point 85 of the mounting element 83 and further includes two arms disposed generally at right angles to each other. The first of the two arms defines a latch catch 90 and extends through a slot 91 in the cabinet top 29 engage with the latch stop 81. The second arm 93 provides a connecting point 94 for the second looped cable end and provides a connecting point 95 for a hook end of the biasing spring 96 to control movement of the latch member 99. The biasing spring 96 is hooked between the second arm 93 of the latch member 99 and the extending arm 86 of the latch mounting element 83. This biasing spring 96 serves to maintain the latch catch 90 in the non-locking position as in FIG. 5 when the clothes basket is not spinning.

In normal operation when the sequence control device 13 enters a portion of the predetermined series of operations that requires the clothes basket to spin at high speed, the upper portion 56 of the latch actuator 55 climbs the cam surface 54 to a position shown generally in FIG. 6 which forces the upper portion 56 radially outward. At the same time, the lower portion 59 moves inward, or to the left in FIG. 6, pulling the attached cable 61 which moves relative to the pulley-like guide 73 and places tension on the cable system. The cable pulls the second arm 93 of the bell crank shaped latch member 99, as in FIG. 5, causing it to pivot clockwise and move latch catch of the first arm 90 into the locking position as in FIG. 4 and to thereby place added tension on the biasing spring 96. After the high speed spin operation the latch actuator 55 drops off the cam surface 54, releasing the cable tension, and allowing the biasing spring 96 of the latch member to restore the latch member to the non-locking position of FIG. 5.

If during the high speed spinning, a predetermined unbalance condition causes the tub assembly 15 to excessively gyrate, the bumper 19 mounted on the tub cover 16 is moved so as to engage the depending lever 43 of the unbalance mechanism 26 and pivot the actuator 39 to the position of FIG. 3 so that the rear end 40 of the actuator 39 is moved downwardly. This motion releases plunger 46, causes de-energization of the apparatus, and effectively latches the rear end 40 of the actuator under the switch plunger 46. The downward movement of the actuator 39 also causes the unbalance-sensitive latch release member 64 to pivot counterclockwise through engagement with arm 65 for moving the second arm 70 toward the machine center line. The pivot action causes the cable 61 that is passed around the pulley-like guide 73 portion of the second arm 70 to lose tension, and thereby enable the biasing spring 96 of the cabinet mounted latch member to move the latch element 90 into an unlocked position, as in FIG. 5. The lid is thus unlocked to permit access to the clothes basket for manual redistribution of the clothes within the basket to eliminate the conditions causing the unbalance.

The apparatus will be maintained de-energized until the unbalance mechanism 26 is reset. The resetting is accomplished automatically upon the opening of the access door 23 by the operator which is a natural part of the redistribution of the clothing. Opening of the access door 23 releases the plunger 31 so that the plunger 31 and actuator 39 move axially to the left under biasing force of the spring 45 to position the plunger 31 in its forward position and to position the actuator rear end 40 in substantial alignment with the switch plunger 46. The unbalance mechanism 26 is now operable for re-energizing the extractor apparatus upon closing of the access door 23. As the unbalance mechanism 26 is reset, the spring biased first arm 65 of the unbalance-sensitive latch release member 64 moves with the actuator 39 as it moves upwardly into alignment with plunger 46. Cable tension is thus restored and the latch catch 90 is returned to the locked position.

It is therefore seen that the instant invention provides clear and distinct advantages over latch mechanisms shown in the prior art. Latching is automatically and positively achieved when the clothes basket is spinning. Also, access to the clothes basket in case of an unbalance condition is provided without any physical requirements on the part of the operator.

In the drawings and specification there has been set forth a preferred embodiment of the invention and although specific terms are employed these are used in a generic and descriptive sense only and not for purposes of limitation. Changes in form and the proportion of parts, as well as the substitution of equivalents are contemplated, as circumstances may suggest or render expedient, without departing from the spirit or scope of this invention as defined in the following claims.

I claim:

1. A selectively operable access door latch mechanism for an apparatus including a plurality of electrically energizable components operable through a series of operations under control of sequential control means having rotatable cam means and a plurality of cam-operated switches for controlling energization of said components and wherein said apparatus includes cabinet means and an access door on said cabinet means operable between a closed position and an open position, the combination comprising: first latch means on said access door; normally disengaged second latch means mounted on said cabinet means for movement relative to said cabinet means into engagement with said first latch means for latching said access door in said closed position; actuator means including an auxiliary cam associated with and rotatable with the cam means of said sequential control means and further including a pivotally mounted latch actuator on said cabinet means for engagement with said auxiliary cam and operatively responsive thereto; mechanical connecting means operatively connected between said latch actuator and said second latch means for transmitting cam-induced movement of said latch actuator to said second latch means; and means for biasing said latch actuator into a first position to maintain said second latch means operatively disengaged from said first latch means, said auxiliary cam being operable during at least one predetermined portion of said series of operations for moving said latch actuator into a second position against said biasing means to move said second latch means into latching engagement with said first latch means for latching said access door in said closed position during said predetermined portion of the series of operations.

2. A selectively operable latch mechanism as described in clain 1 wherein said sequential control means includes a dial rotatable therewith for indicating the progress of said series of operations and wherein said auxiliary cam is an integrally molded part of said dial.

3. a selectively operable latch mechanism as described in claim 1 wherein said mechanical connecting means between said latch actuator and said second latch means comprises a cable which transmits said movement of said latch actuator to said second latch means.

4. A selectively operable latch mechanism as described in claim 3 wherein said mechanical connecting means between said latch actuator and said second latch means includes an adjustment and cornering means comprising a pivotally mounted cable guide means having a threaded member for adjusting said cable guide means relative to said cabinet means.

5. An unbalance-responsive access door latch control mechanism for an apparatus including a rotatable member, a cabinet means substantially enclosing said rotatable member, an access door on said cabinet means operable between a closed position and an open position, and a plurality of electrically energizable components, the combination comprising: normally disengaged latch means on said cabinet means operable for locking said access door in said closed position;

sequential control means having cam means and a plurality of cam-operated switches for energizing and controlling said components through a series of operations and including an auxiliary cam for initiating engagement of said latch means; cam-responsive latch actuator means pivotally mounted on said cabinet means for engagement with said auxiliary cam and movable responsive thereto; mechanical connecting means operatively connected between said latch actuator and said latch means for transmitting cam-induced movement of said latch actuator to said latch means to effect engagement of said latch means and thus lock said access door in the closed position during at least one portion of said series of operations under control of said auxiliary cam; unbalance mechanism on said cabinet means movable responsive to excessive gyrational movement of said rotatable member and including an auxiliary switch for interrupting operation of said apparatus; and unbalance-sensitive latch release means responsive to a predetermined movement of said unbalance mechanism for operatively disconnecting said latch actuator from said latch means whereby said latch means is unlocked to permit the access door to be opened after unbalance-induced interruption of operation of said apparatus.

6. An unbalance-responsive latch control mechanism as described in claim 5 wherein said auxiliary switch is responsive to said unbalance mechanism for deenergizing said apparatus concomitant with operation of said latch release means.

7. An unbalance-responsive latch control mechanism as described in claim 5 wherein said unbalance-sensitive latch release means includes a unitary member having a first arm engageable with said unbalance mechanism and a second angularly displaced arm operatively connected to said mechanical connecting means whereby said response to said movement of said unbalance mechanism is transmitted to operatively disconnect said latch means.

8. An unbalance responsive latch control mechanism as described in claim 7 wherein an extension spring biases said unitary member to maintain said engagement of said first arm with said unbalance mechanism.

9. A combined access door latch and unbalance-responsive control mechanism for an apparatus having a rotatable member, a cabinet means substantially enclosing said rotatable member, an access door on said cabinet means operable between a closed position and an open position and a plurality of electrically energizable components, the combination comprising: first latch means on said access door; normally disengaged second latch means cooperatively operable with said first latch means to lock said access door in said closed position; sequential control means having cam means and a plurality of cam-operated switches for energizing and controlling said componets through a series of operations and including an auxiliary cam for initiating engagement of said latch means; cam-responsive latch actuator means pivotally mounted on said cabinet means for engagement with said auxiliary cam and movably responsive thereto; mechanical connecting means operatively connected between said latch actuator and said second latch means for transmitting cam-induced movement of said latch actuator to said second latch means to lock said access door in the closed position during at least one portion of said series of operations under control of said auxiliary cam; unbalance mechanism on said cabinet means movable responsive to excessive gyrational movement of said rotatable member and including an auxiliary switch for interrupting operation of said apparatus; and unbalance-sensitive latch release means responsive to a predetermined movement of said rotatable member to effectively disconnect said latch actuator means from said second latch means whereby said second latch means is effectively disconnected from said first latch means thereby allowing the access door to be opened after unbalance-induced interruption of operation of said apparatus.

10. A combined access door latch and unbalance-responsive control mechanism as described in claim 9 and further including a spring member for biasing said second latch means toward an unlocked position with relation to said first latch means, said auxiliary cam being operable at a predetermined position in said series of operations for effecting movement of said second latch means against the biasing of said spring member into locking engagement with said first latching means.

11. A combined access door latch and unbalance-responsive control mechanism as described in claim 9 wherein said first latch means includes a spring loaded latch stop and wherein said latch stop has a downwardly facing ramp whereby said access door is operable from said open position to said closed position but is not operable from said closed to said open position when said second latch means has been moved to the preset locking position.

* * * * *